US009790805B2

(12) United States Patent
Takemaru et al.

(10) Patent No.: US 9,790,805 B2
(45) Date of Patent: Oct. 17, 2017

(54) STEAM VALVE DEVICE AND STEAM TURBINE PLANT

(75) Inventors: Ryuhei Takemaru, Kanagawa (JP); Osamu Shindo, Kanagawa (JP); Toshihiko Endo, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 250 days.

(21) Appl. No.: 13/423,763

(22) Filed: Mar. 19, 2012

(65) Prior Publication Data

US 2012/0240580 A1 Sep. 27, 2012

(30) Foreign Application Priority Data

Mar. 25, 2011 (JP) ..... 2011-068654

(51) Int. Cl.
*F01D 17/14* (2006.01)
*F01D 17/18* (2006.01)
*F01D 9/04* (2006.01)

(52) U.S. Cl.
CPC ..... *F01D 17/145* (2013.01); *F01D 9/047* (2013.01); *F01D 17/18* (2013.01);
(Continued)

(58) Field of Classification Search
CPC ..... F01K 1/06; F01K 1/08; F01K 1/12; F01K 1/14; F01K 1/16; F01K 1/18; B65D 39/06; B65D 39/08; E21D 23/26; F01D 17/145; F01D 17/18; F01D 9/047; F01D 25/28; F04B 49/225; F16K 1/305; F16K 1/306; F16K 1/307; F16K 1/526; F16K 11/202;
(Continued)

(56) References Cited

U.S. PATENT DOCUMENTS 1,456,090 A * 5/1923 Bennett ..... F01D 17/145 137/629
1,680,736 A * 8/1928 Hodgkinson ..... F01D 17/145 137/50
(Continued)

FOREIGN PATENT DOCUMENTS

CN 2782938 Y 5/2006
CN 101813225 A 8/2010
(Continued)

*Primary Examiner* — Mark Laurenzi
*Assistant Examiner* — Xiaoting Hu
(74) *Attorney, Agent, or Firm* — Foley & Lardner LLP

(57) ABSTRACT

In the embodiment, a steam valve device has, a steam regulating valve, and an intermediate flow path connecting the main steam stop valve and the steam regulating valve. The main steam stop valve and the steam regulating valve respectively have: casings where flow paths are formed between horizontal inlet ports and outlet ports opened downward and valve seats are arranged in the flow paths; valve elements movable up and down in the casings; and valve rods for driving the valve elements. The valve rods extend upward, and they are pulled off upward in a direction to outside of the casings when opening the flow paths. The intermediate flow path changes the flow direction of main steam flowing out of the outlet port of the main steam stop valve from downward direction to horizontal direction to guide the main steam toward the outlet ports of the steam regulating valves.

18 Claims, 7 Drawing Sheets

(52) U.S. Cl.
CPC ... *F05D 2220/31* (2013.01); *Y10T 137/87121* (2015.04); *Y10T 137/87877* (2015.04); *Y10T 137/87917* (2015.04)

(58) Field of Classification Search
CPC ..... F16K 7/16; F16K 11/022; F16K 11/20; F16K 11/22; F16K 27/003; F17C 13/04; G05D 16/10; Y10T 137/87877; Y10T 137/87121; Y10T 137/87917
USPC ..... 60/645, 657, 660, 670, 39.182, 39.3; 137/613, 637.2, 241, 238, 614.16–614.19, 137/630, 630.14, 630.15, 630.13, 625.3, 137/883; 184/83; 222/330, 331, 500; 138/DIG. 11, 177
See application file for complete search history.

(56) References Cited

U.S. PATENT DOCUMENTS 3,097,489 A * 7/1963 Eggenberger et al. . F01D 17/18 415/15
3,241,322 A * 3/1966 Strohmeyer, Jr. ..... F01D 17/18 411/959
3,458,170 A * 7/1969 Vogeli ..... F01D 17/145 251/122
3,533,710 A * 10/1970 Haug ..... F01D 25/28 137/15.18
3,623,511 A * 11/1971 Levin ..... F16L 43/00 138/177
4,120,159 A * 10/1978 Matsumoto et al. ... F01D 19/02 290/40 C
4,398,393 A * 8/1983 Ipsen ..... 60/657
4,481,776 A * 11/1984 Araki et al. ..... 60/660
4,604,028 A * 8/1986 Yeaple et al. ..... F01D 17/18 415/38
4,697,983 A * 10/1987 Yamaguchi ..... F01D 9/047 415/134
5,095,943 A * 3/1992 Ashi ..... 137/599.16
5,388,960 A * 2/1995 Suzuki ..... F01D 25/26 415/108
5,411,365 A * 5/1995 Mazzola ..... F01D 25/24 415/108
6,070,605 A * 6/2000 Steenburgh ..... 137/1
6,637,207 B2 * 10/2003 Konezciny et al. ..... 60/727
6,655,409 B1 * 12/2003 Steenburgh et al. .... 137/614.19
6,748,932 B1 * 6/2004 Sorter et al. ..... 123/527
8,042,570 B2 10/2011 Shindo
2008/0163624 A1 * 7/2008 Augustinson ..... F02B 33/44 60/624
2009/0159141 A1 6/2009 Shindo
2010/0232958 A1 * 9/2010 Iwai ..... F01D 9/047 415/208.1

FOREIGN PATENT DOCUMENTS

CN 101832625 A 9/2010
JP 60-209605 A 10/1985
JP 2009-156040 A 7/2009
KR 10-0992894 A 11/2010

* cited by examiner

STEAM VALVE DEVICE AND STEAM TURBINE PLANT

CROSS-REFERENCE TO RELATED APPLICATIONS

This application claims priority from Japanese Patent Application 2011-068654, filed Mar. 25, 2011, which is incorporated herein by reference in its entirety.

FIELD

Embodiments of the described herein relate generally to a steam valve device having a main steam stop valve and a steam regulating valve and to a steam turbine plant having the steam valve device.

BACKGROUND

In a conventional typical steam turbine plant, steam from a boiler is passed through a steam valve device and is then fed to a steam turbine. The steam after working in the steam turbine is condensed into water by a steam condenser, and the water is pressurized by a feed pump to be fed again to the boiler. In this manner, the steam circulates in the steam turbine plant.

The steam valve device has a main steam stop valve and a steam regulating valve disposed on the downstream side of the main steam stop valve. The main steam stop valve can stop steam flowing in a steam turbine in a moment when an emergency occurs in the turbine. The steam regulating valve controls the flow rate of steam fed to the steam turbine.

In some steam valve device, the main steam stop valve and steam regulating valve are integrated. Various integration approaches have been proposed and, for example, there is known a configuration in which the main steam stop valve and a steam regulating valve are integrated through an intermediate flow pipe and they are each driven by an oil cylinder disposed above a casing.

In the abovementioned steam valve device, one main steam stop valve and one steam regulating valve constitute one pair. Thus, the steam regulating valve in a conventional steam turbine plant is suitable for a steam turbine plant adopting a throttle control system. In the throttle control system, the steam regulating valve is not fully open in a partial load condition of the steam turbine, incurring a throttle loss.

Meanwhile, steam turbine plants are being increased in capacity of the single power output (generation capacity) and, correspondingly, the diameter of each valve of the steam valve device tends to increase. Under such circumstances, an increase in the efficiency of the steam turbine in its partial load condition is required. For such a steam turbine plant focusing on the efficiency in the partial load condition of the steam turbine, a nozzle control system is suitable. In the nozzle control system, parts of the steam regulating valves are substantially fully opened at the partial load condition of the steam turbine, suppressing the throttle loss.

In a steam turbine plant adopting the nozzle control system, a configuration in which a nozzle box serving as a member for feeding steam to a turbine stage of the steam turbine is partitioned into a plurality of sections in the circumferential direction is used. In the case where the above steam valve device is applied to a steam turbine plant adopting the nozzle control system, it is necessary to provide the number of valves corresponding to the number of the circumferentially-arranged sections of the nozzle box. For example, in the case where the nozzle box is partitioned into four sections in the circumferential direction, four pairs of valves, i.e., four main steam stop valves and four steam regulating valves are required. Thus, manufacturing cost is increased.

DETAILED DESCRIPTION

The present embodiments have been made to solve the above problem, and an object thereof is to improve maintenance workability of a steam valve device and to achieve a reduction in a pressure loss of the steam valve device during valve open time period and a reduction of manufacturing cost of the steam valve device.

In order to achieve the object described above, there is presented a steam valve device comprising: a main steam stop valve; a plurality of steam regulating valves disposed on a downstream side of the main steam stop valve; and an intermediate flow pipe connecting the main steam stop valve to the plurality of steam regulating valves, wherein the main steam stop valve includes: a first casing having a horizontally-opened first inlet port, a first outlet port opened vertically and connected to the intermediate flow pipe, a first flow path formed between the first inlet port and the first outlet port, and a first valve seat arranged in the first flow path; a first valve element configured to move up and down in the first casing and to leave and contact the first valve seat, thereby to open and close the first flow path; and a first valve rod connected to the first valve element, configured to slide up and down, penetrating the first casing, and configured to move away from the first outlet port when the first flow path is opened, wherein the steam regulating valves each includes: a second casing having a second inlet port horizontally opened so as to be connected to the intermediate flow pipe, a second outlet port opened vertically, a second flow path formed between the second inlet port and the second outlet port, and a second valve seat arranged in the second flow path; a second valve element configured to move up and down in the second casing and to leave and contact the second valve seat, thereby to open and close the second flow path; and a second valve rod connected to the second valve element, configured to slide up and down, penetrating the second casing, and configured to move away from the second outlet port when the second flow path is opened, wherein the intermediate flow pipe is configured to change the flow direction of main steam flowing out from the first outlet port from a vertical direction to a horizontal direction to allow the main steam to flow into the second inlet ports.

Figure 8:
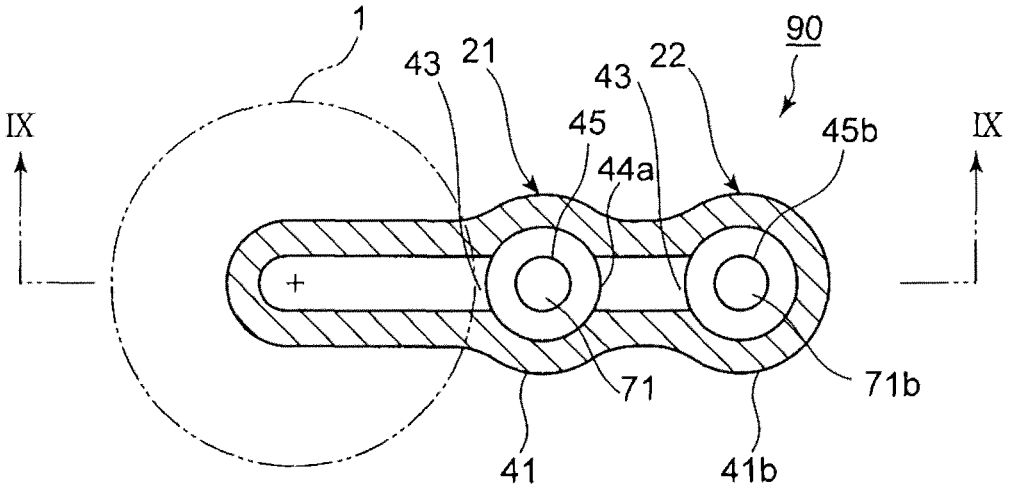
FIG. 8 is a top view schematically illustrating a steam valve device according to a third embodiment of the present invention.
Figure 9:
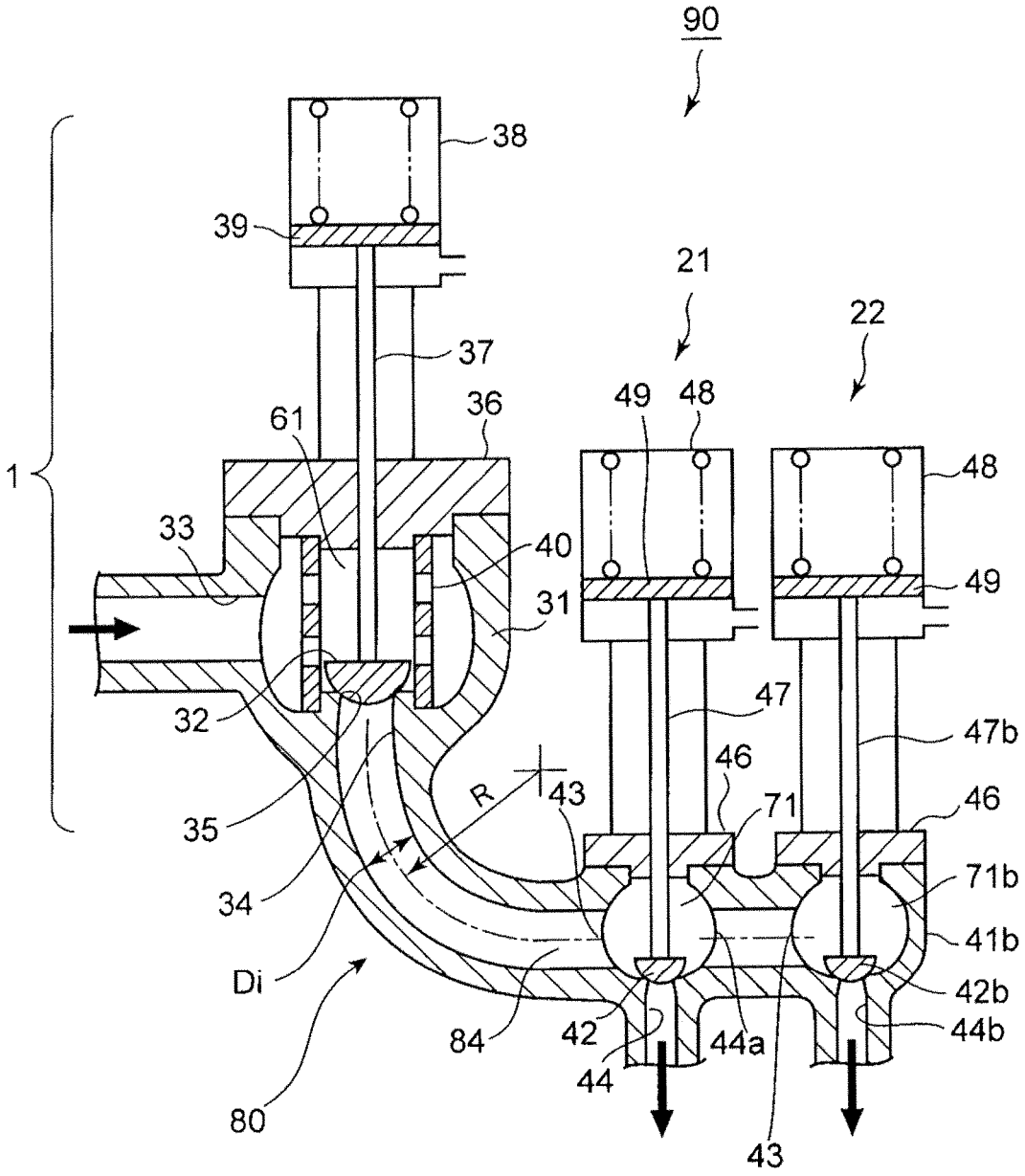
FIG. 9 is a vertical cross-sectional diagram as viewed along IX-IX line of FIG. 8.

There is also presented a steam valve device comprising: a main steam stop valve; an upstream side steam regulating valve disposed on the downstream side of the main steam stop valve; a downstream side steam regulating valve disposed on a downstream side of the upstream side steam regulating valve; and an intermediate flow pipe connecting the main steam stop valve to the upstream side steam regulating valve, wherein the main steam stop valve includes: a first casing having a horizontally-opened first inlet port, a first outlet port opened vertically and connected to the intermediate flow pipe, a first flow path formed between the first inlet port and the first outlet port, and a first valve seat arranged in the first flow path; a first valve element configured to move up and down in the first casing and to leave and contact the first valve seat, thereby to open and close the first flow path; and a first valve rod connected to the first valve element, configured to slide up and down, penetrating the first casing, and configured to move away from the first outlet port when the first flow path is opened, wherein the upstream side steam regulating valve includes: a second casing having a second inlet port horizontally opened so as to be connected to the intermediate flow pipe, a second outlet port opened vertically, a horizontal outlet port opened on the downstream side relative to the second vertical outlet port, a second flow path communicating with the second inlet port, the second outlet port, and the horizontal outlet port, and a second valve seat arranged in the second flow path; a second valve element configured to move up and down in the second casing and to leave and contact the second valve seat, thereby to open and close the second flow path; and a second valve rod connected to the second valve element, configured to slide up and down, penetrating the second casing, and configured to move away from the second outlet port when the second flow path is opened, wherein the downstream side steam regulating valve includes: a third casing 41*b* having a third inlet port 43 horizontally opened so as to be connected to the horizontal outlet port, a third outlet port 44*b* opened vertically downward, a third flow path 71*b* formed between the third inlet port 43 and the third outlet port 44*b*, and a third valve seat 45*b* arranged in the third flow path 71*b*; a third valve element 42*b* configured to move up and down in the third casing 41*b* and to leave and contact the third valve seat 45*b*, thereby to open and close the third flow path 71*b*; and a third valve rod 47*b* connected to the third valve element 42*b*, configured to slide up and down, penetrating the third casing 41*b*, and configured to move away from the third outlet port 44*b* when the third flow path 71*b* is opened, wherein the intermediate flow pipe is configured to change the flow direction of main steam flowing out from the first outlet port from vertical direction to horizontal direction to allow the main steam to flow in the second inlet port (see, for example, FIGS. 8 and 9).

There is also presented a steam turbine plant comp rising: a boiler; a steam turbine receiving main steam generated in the boiler and being driven by an energy of the main steam; and at least one steam valve device disposed between the boiler and the steam turbine so as to control flow of the main steam, wherein the steam valve device includes: a main steam stop valve; a plurality of steam regulating valves disposed on a downstream side of the main steam stop valve; and an intermediate flow pipe connecting the main steam stop valve to the plurality of steam regulating valves, wherein the main steam stop valve includes: a first casing having a horizontally-opened first inlet port, a first outlet port opened vertically and connected to the intermediate flow pipe, a first flow path formed between the first inlet port and the first outlet port, and a first valve seat arranged in the first flow path; a first valve element configured to move up and down in the first casing and to leave and contact the first valve seat, thereby to open and close the first flow path; and a first valve rod connected to the first valve element, configured to slide up and down, penetrating the first casing, and configured to move away from the first outlet port when the first flow path is opened, wherein the steam regulating valves each includes: a second casing having a second inlet port horizontally opened so as to be connected to the intermediate flow pipe, a second outlet port opened vertically, a second flow path formed between the second inlet port and the second outlet port, and a second valve seat arranged in the second flow path; a second valve element configured to move up and down in the second casing and to leave and contact the second valve seat, thereby to open and close the second flow path; and a second valve rod connected to the second valve element, configured to slide up and down, penetrating the second casing, and configured to move away from the second outlet port when the second flow path is opened, wherein the intermediate flow pipe is configured to change the flow direction of main steam flowing out from the first outlet port from vertical direction to horizontal direction to allow the main steam to flow into the second inlet ports.

Embodiments of the present invention will be described below with reference to the accompanying drawings. Throughout the drawings, the same reference numerals refer to the same or similar parts, and redundant descriptions are omitted.

First Embodiment

Figure 1:
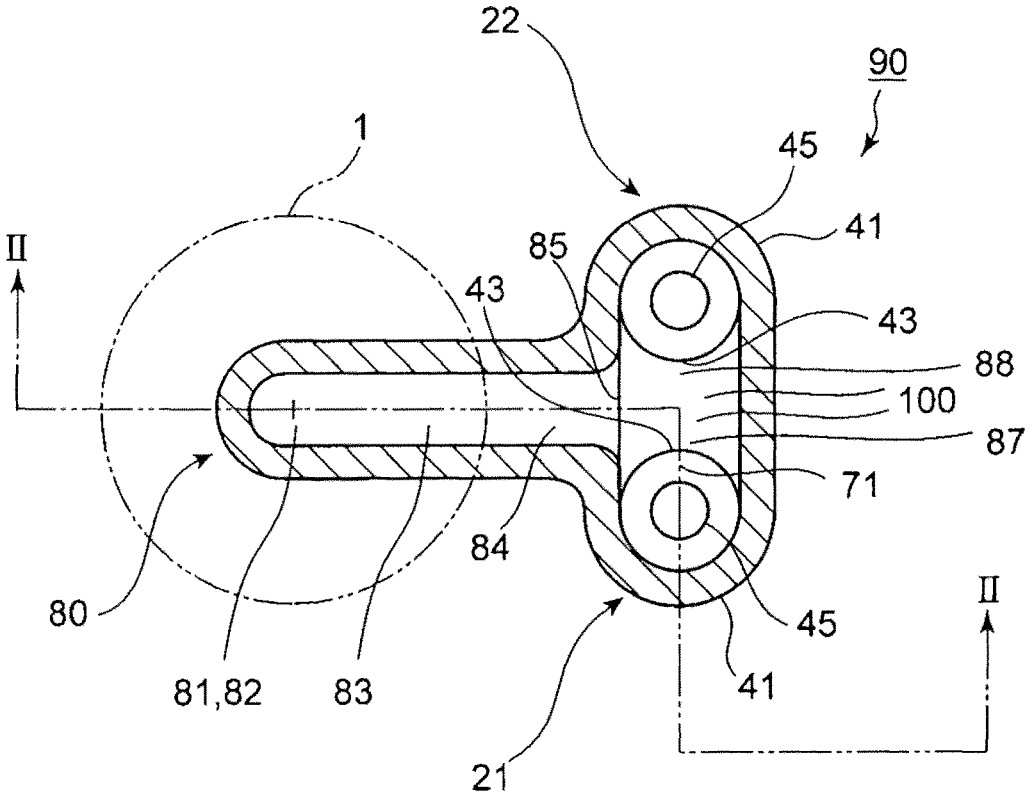
FIG. 1 is a top view schematically illustrating a steam valve device according to a first embodiment of the present invention.
Figure 2:
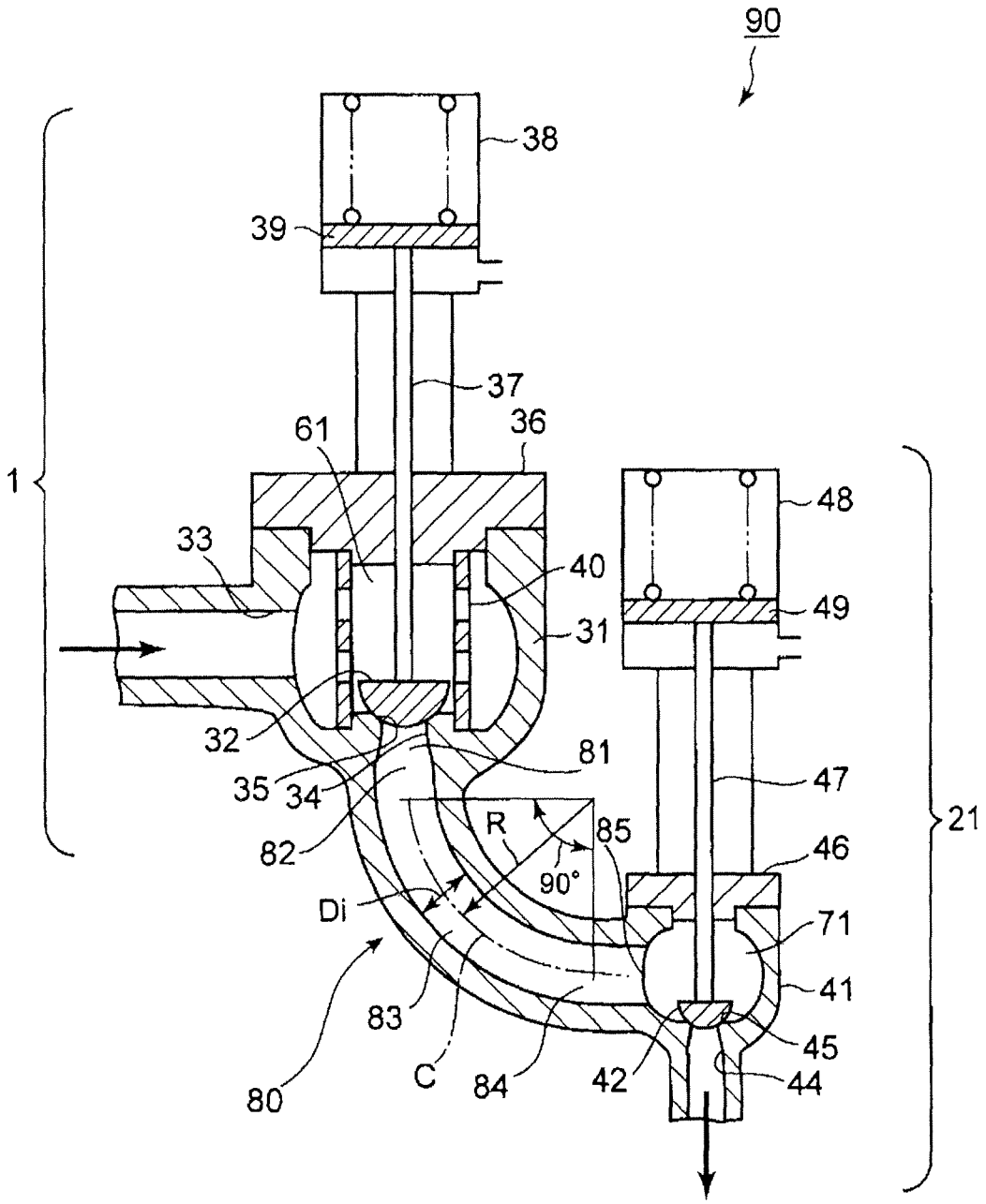
FIG. 2 is a vertical cross-sectional diagram as viewed along II-II line of FIG. 1.

A first embodiment will be described with reference to FIGS. 1 to 4. FIG. 1 is a top view schematically illustrating a steam valve device 90 according to the present embodiment. FIG. 2 is a vertical cross-sectional diagram as viewed along II-II line of FIG. 1.

Figure 3:
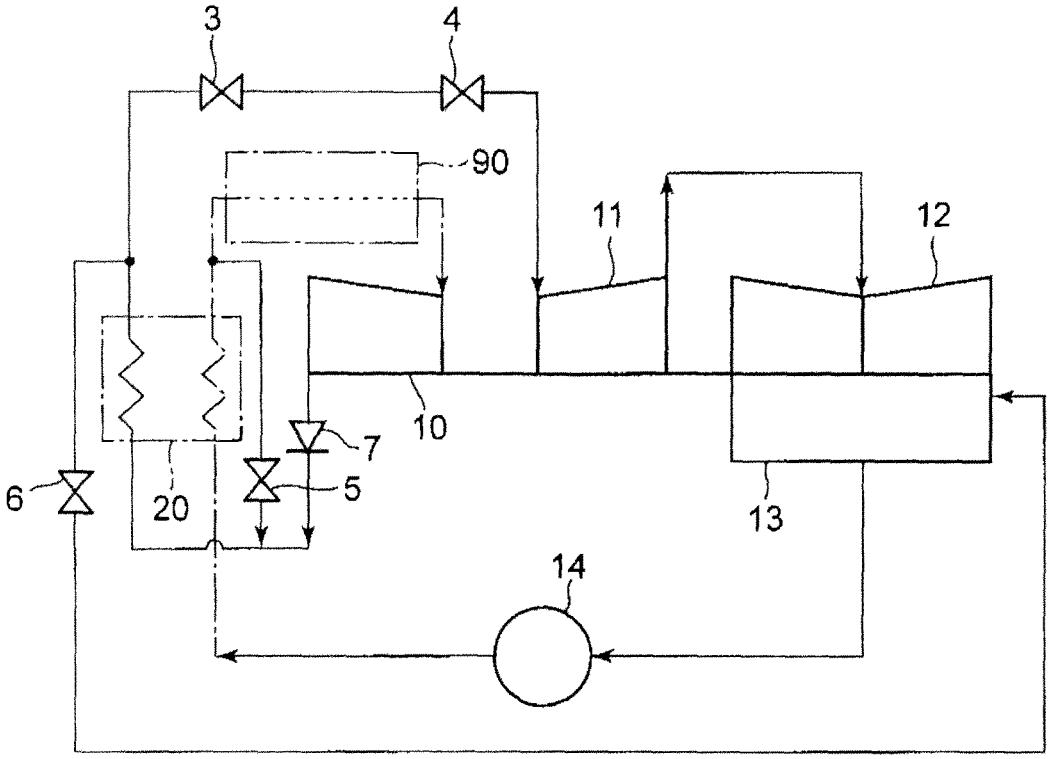
FIG. 3 is a systematic diagram schematically illustrating an embodiment of a steam turbine plant having the steam valve device of FIG. 1.
Figure 4:
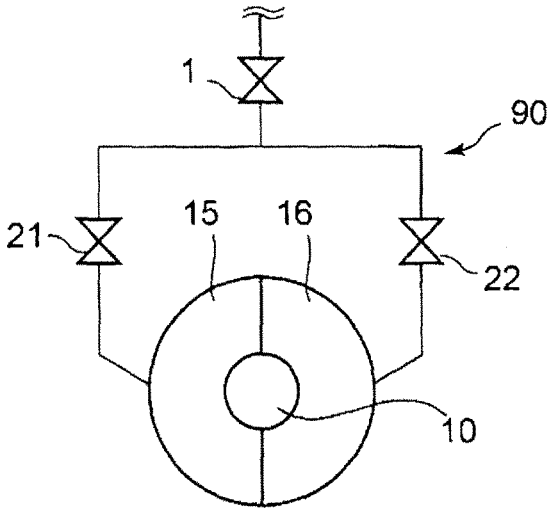
FIG. 4 is a partial systematic diagram of a high pressure steam turbine and the steam valve device of FIG. 3.

FIG. 3 is a systematic diagram schematically illustrating a steam turbine plant having the steam valve device 90. In the steam valve device 90 of FIG. 3, a main steam stop valve 1 and the like are omitted and only a square frame is illustrated. FIG. 4 is a partial systematic diagram of the high pressure steam turbine 10 and the steam valve device 90 of FIG. 3.

First, the entire configuration of a steam turbine plant in which the steam valve device 90 of the present embodiment is disposed will be described.

The steam turbine plant has a boiler 20, a high pressure steam turbine 10, and a steam valve device 90. The main steam generated in the boiler 20 is introduced to the high pressure steam turbine 10, and the high pressure steam turbine 10 is driven by the energy of the main steam. The steam valve device 90 is disposed between the boiler 20 and the high pressure steam turbine 10 so as to control the flow of the main steam. In the steam turbine plant, the steam from the boiler 20 is passed through the steam valve device 90 and is then fed to the high pressure steam turbine 10 (FIG. 3).

The steam after working in the high pressure steam turbine 10 is fed through a check valve 7 to a reheater of the boiler 20 to be reheated. The reheated steam is then fed to an intermediate pressure steam turbine 11 through a reheated steam stop valve 3 and an intercept valve 4 and further fed to a low pressure steam turbine 12 to be worked. The steam discharged from the low pressure steam turbine 12 is condensed into water by a steam condenser 13, and the water is pressurized by a feed pump 14 to be fed again to the boiler 20. In this manner, the steam circulates in the steam turbine plant.

In the illustrated example, in order to increase operation efficiency of the plant, a high pressure turbine bypass valve 5 connecting the upstream side of the main steam stop valve I and the upstream side of the reheater of the boiler 20 and a low pressure turbine bypass valve 6 connecting the downstream side of the reheater of the boiler 20 and the steam condenser 13 are provided. Thus circulating operation can be achieved by a boiler system alone regardless of the operation of the turbine.

The steam valve device 90 according to the present embodiment has an upstream side main steam stop valve I, two steam regulating valves disposed on the downstream side of the main steam stop valve I, i.e., a first steam regulating valve 21 and a second steam regulating valve 22, and an intermediate flow pipe 80 communicating between the main steam stop valve 1 and the two steam regulating valves 21 and 22 (FIGS. 1 and 2). The main steam stop valve 1, the first steam regulating valve 21, and the second steam regulating valve 22 are vertical type (vertically installed) valves. The main steam stop valve 1 is branched on the downstream side of the intermediate flow pipe 80 to be connected to the first steam regulating valve 21 and the second steam regulating valve 22. FIG. 2 illustrates a state where both the main steam stop valve 1 and the first steam regulating valve 21 are closed.

Although the details are omitted, a nozzle box disposed in the outer circumference of the high pressure steam turbine 10 of the present embodiment is constituted by two circumferentially-partitioned sections, i.e., a first section 15 and a second section 16. The main steam passed through the first steam regulating valve 21 flows in the first section 15 of the nozzle box, and the main steam passed through the second steam regulating valve 22 flows in the second section 16 of the nozzle box (FIG. 4).

The main steam stop valve 1 has a first casing 31 forming a first flow path 61 and a first valve element 32 configured to move up and down in the first casing 31.

The first casing 31 has a first inlet port 33 horizontally opened so as to receive steam and a first outlet port 34 vertically opened so as to discharge steam downward. An inwardly-bulging first valve seat 35 is formed at the first outlet port 34. When the first valve element 32 moves up and down, the first valve element 32 and the first valve seat 35 leave and contact each other to thereby open and close the first flow path 61.

A first valve cover 36 capable being opened at maintenance time is disposed on the upper part of the first casing 31. A first valve rod 37 is attached to the first valve element 32. The first valve rod 37 extends upward from the first valve element 32 so as to penetrate the first valve cover 36 to be connected to a first piston 39 of the first casing 31 in a first oil cylinder 38.

The first valve rod 37 is attached to one side of the first valve element 32 opposite to the first outlet port 34. When the first valve element 32 leaves the first valve seat 35, that is, when the first flow path 61 is opened, the first valve rod 37 is moved away from the first outlet port 34. A strainer 40 is disposed inside the first casing 31 and outside the first valve element 32.

The first steam regulating valve 21 and the second steam regulating valve 22 have the same configuration, and the main steam from the main steam stop valve 1 flows in the first and the second steam regulating valves 21 and 22, respectively. The flow of the main steam will be described later.

Each of the first and the second steam regulating valves 21 and 22 has the same arrangement as the above main steam stop valve 1 and includes a second casing 41 forming a second flow path 71 and a second valve element 42 moving up and down in the second casing 41. The second flow path 71 is a flow path in which the main steam can flow downward in the vertical direction.

The second casing 41 of the first steam regulating valve 21 and the second casing 41 of the second steam regulating valve 22 are formed integrally with first and the second lower outlet ports 87 and 88 to be described later. The second casing 41 of each of the first and the second steam regulating valves 21 and 22 has a second inlet port 43 horizontally opened so as to receive steam and a second outlet port 44 vertically opened so as to discharge steam downward.

The second inlet port 43 of the first steam regulating valve 21 and the second inlet port 43 of the second steam regulating valve 22 face each other through the intermediate flow pipe 80 (FIG. 1). Connection between the first inlet port 43 and the like and the intermediate flow pipe 80 will be described later.

An inwardly-bulging second valve seat 45 is formed at the second outlet port 44 of each of the first and the second steam regulating valves 21 and 22. When the second valve element 42 moves up and down, the second valve element 42 and the second valve seat 45 leave and contact each other to thereby open and close the second flow path 71.

A second valve cover 46 capable being opened at maintenance time is disposed on the upper part of the second casing 41 of each of the first and the second steam regulating valves 21 and 22. A second valve rod 47 is attached to the second valve element 42. The second valve rod 47 extends upward from the second valve element 42. The second valve rod 47 penetrates the second valve cover 46 of the second casing 41, and is connected to a second piston 49 in a second oil cylinder 48.

Each second valve rod 47 is attached to one side of each second valve element 42 opposite to the second outlet port 44. When the second valve element 42 leaves the second valve seat 45, that is, when the second flow path 71 is opened, the second valve rod 47 is moved away from the second outlet port 44.

The intermediate flow pipe 80 has an upper inlet port 81, a vertical flow channel 82, a flow direction changing portion 83 (i.e., a direction changing flow channel), a horizontal flow channel 84, a branch portion 85, and two lower outlet ports, i.e., a first lower outlet port 87 and a second lower outlet port 88 (FIGS. 1 and 2).

The upper inlet port 81 is opened upward so as to be connected to the first outlet port 34. The main steam flowing out from the first outlet port 34 can flow in the upper inlet port 81.

The vertical flow channel 82 is connected to the lower portion of the upper inlet port 81 so as to allow the main steam flowing in the upper inlet port 81 to flow therein vertically downward.

The flow direction changing portion 83 is formed into an arc-like pipe (elbow pipe) having an arc angle of about 90 degrees so as to allow the main steam flowing in the upper inlet port 81 and the vertical flow channel 82 to flow therein. The flow direction changing portion 83 changes the flow direction of the main steam from vertical direction to horizontal direction. The horizontal flow channel 84 is connected to the lower portion of the flow direction changing portion 83 to allow the main steam flowing in the flow direction changing portion 83 to flow therein and then to flow horizontally.

The branch portion 85 allows the main steam flowing in the flow changing portion 83 and the horizontal flow channel 84 to flow therein. The steam that has passed through the branch portion 85 can flow in the second inlet port 43 of the first steam regulating valve 21 and the second inlet port 43 of the second steam regulating valve 22.

In the present embodiment, the main steam stop valve 1, the first steam regulating valve 21, the second steam regulating valve 22, and the intermediate flow pipe 80 can be formed integrally by forging or casting.

Subsequently, the flow of the main steam in the steam valve device 90 of the present embodiment will be described.

The main steam fed from the boiler 20 flows horizontally in the first casing 31 of the main steam stop valve 1 from the first inlet port 33. The main steam then flows in the strainer 40, passes between the first valve element 32 and the first valve seat 35, and flows downward to pass through the first outlet port 34. Thus, the main steam goes through the main steam stop valve 1.

The main steam that has gone through the main steam stop valve 1 passes through the upper inlet port 81 of the intermediate flow pipe 80 and flows in the vertical flow channel 82. The main steam passes in the vertical flow channel and flows in the flow changing portion 83. At this time, the flow direction of the main steam is changed from downward direction to the horizontal direction. The main steam passes in the flow direction changing portion 83 and then flows in the branch portion 85.

The flow of the main steam flowing in the branch portion 85 is branched into two outlet flow paths 100: a part flows in the first lower outlet port 87, and the rest flows in the second lower outlet port 88.

The main steam flowing in the first lower outlet port 87 flows in the second casing 41 through the second inlet port 43 of the first steam regulating valve 21. The steam that has entered the second casing 41 passes between the second valve element 42 and the second valve seat 45 of the first steam regulating valve 21, and is discharged downward from the second outlet port 44. In this manner, the main steam flowing in the first lower outlet port 87 passes through the first steam regulating valve 21. The main steam that has passed through the first steam regulating valve 21 is fed to the first section 15 of the nozzle box.

The main steam flowing in the second lower outlet port 88 flows in the second casing 41 through the second inlet port 43 of the second steam regulating valve 22. The steam that has entered the second casing 41 passes between the second valve element 42 and the second valve seat 45 of the second steam regulating valve 22, and is discharged downward from the second outlet port 44. In this manner, the main steam flowing in the second lower outlet port 88 passes through the second steam regulating valve 22. The main steam that has passed through the second steam regulating valve 22 is fed to the second section 16 of the nozzle box.

In order to avoid a fluid separation phenomenon inside the intermediate flow pipe 80, the ratio (R/Di) between a central radius R of the arc of the flow direction changing portion 83 and an inner diameter Di of the flow direction changing portion 83 is preferably large. Specifically Concretely, the R/Di is preferably 1 or more and, more preferably, 2 or more.

The first valve element 32 of the main steam stop valve 1 moves up and down in conjunction with the first piston 39 through the first valve rod 37. When the main steam stop valve 1 is operated in the opening direction, the first valve rod 37 is pulled up in the upstream side so as not to interfere with the flow path of the steam, thereby reducing a pressure loss caused by the first valve rod 37.

Similarly, the second valve element 42 of each of the first and the second steam regulating valves 21 and 22 moves up and down in conjunction with the second piston 49 through the second valve rod 47. When each of the first and the second steam regulating valves 21 and 22 is operated in the opening direction, the second valve rod 47 is pulled up in the upstream side so as not interfere with the flow path of the steam, thereby reducing a pressure loss caused by the second valve rod 47.

Further, according to the present embodiment, the main steam stop valve 1, the first steam regulating valve 21, and the second steam regulating valve 22 can be of vertical type (installed vertically). As a result, the valve rod does not bend by the weight of the valve element at assembly time. Therefore, the valve element formed at the leading end of the valve rod can easily be set into contact with the valve seat. In addition, the internal components, such as an oil cylinder and a top cover, can be hoisted up and down in a vertical position when overhauling the valves, by using an overhead crane. This helps to perform the maintenance work in safety.

In general, centrifugal force acts on the fluid inside the elbow, and the centrifugal force acting on the fluid central part at which the flow rate is high is greater than that acting on the fluid part near the wall surface at which the flow rate is low, so that the fluid central part is pushed outward to the outer circumference of the elbow, while the fluid near the pipe w all migrates inward. Further, the pressure distribution of the wall surface in the elbow cross-section is not uniform. That is, the pressure is higher at the outer circumference of the elbow and lower at the inner circumference thereof, so that a secondary flow is generated in the elbow. The secondary flow causes fluid separation as a consecutive flow of the secondary flow, which will be described below.

(1) Along the outer circumference of the elbow, the pressure gradually rises toward the bending part of the elbow. Therefore, separation develops at the entrance of the bending part of the elbow.

(2) Along the inner circumference of the elbow, the pressure is lower. At the end (exit part) of the elbow, the centrifugal force decreases and the pressure starts rising. As a result, the flow undergoes separation after passing the bending part of the elbow.

A greater part of the steam-pressure loss in the intermediate flow pipe 80 of the present embodiment is attributed to the fluid separation in the elbow.

As described above, the fluid separation in the intermediate flow pipe 80 can be avoided when the ratio (R/Di) between the central radius R of the arc of the flow direction changing portion 83 and the inner diameter Di of the intermediate flow pipe 80 is set to 1 or more and preferably 2 or more. Thus, the pressure loss in the intermediate flow pipe 80 can be reduced.

Further, the steam turbine plant according to the present embodiment is configured to allow the main steam passing through the first and the second steam regulating valves 21 and 22 to flow in the first and the second sections 15 and 16 of the nozzle box. Thus, it is possible to perform so-called nozzle control operation in which the first and the second steam regulating valves 21 and 22 are opened one by one in sequence.

Second Embodiment

Figure 5:
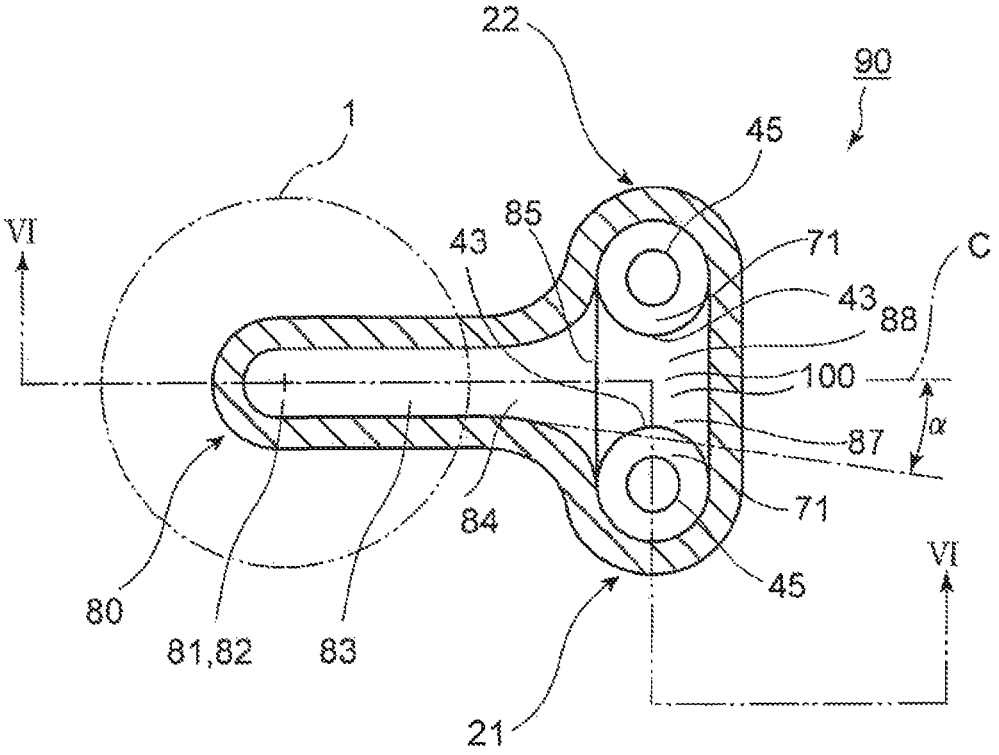
FIG. 5 is a top view schematically illustrating a steam valve device according to a second embodiment of the present invention.
Figure 6:
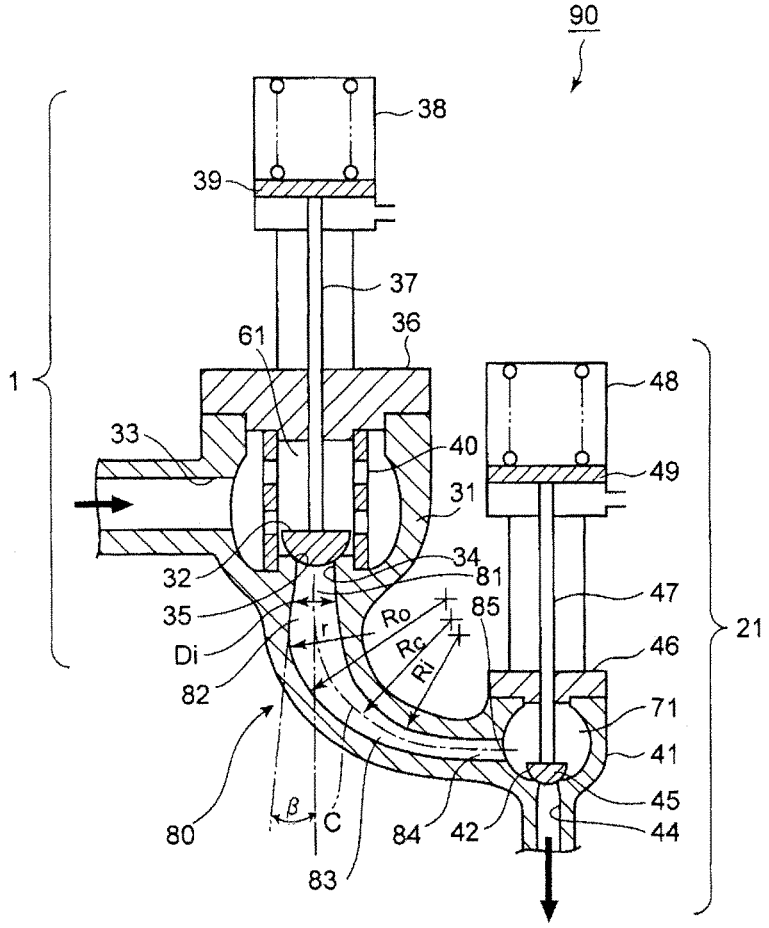
FIG. 6 is a vertical cross-sectional diagram as viewed along VI-VI line of FIG. 5.
Figure 7:
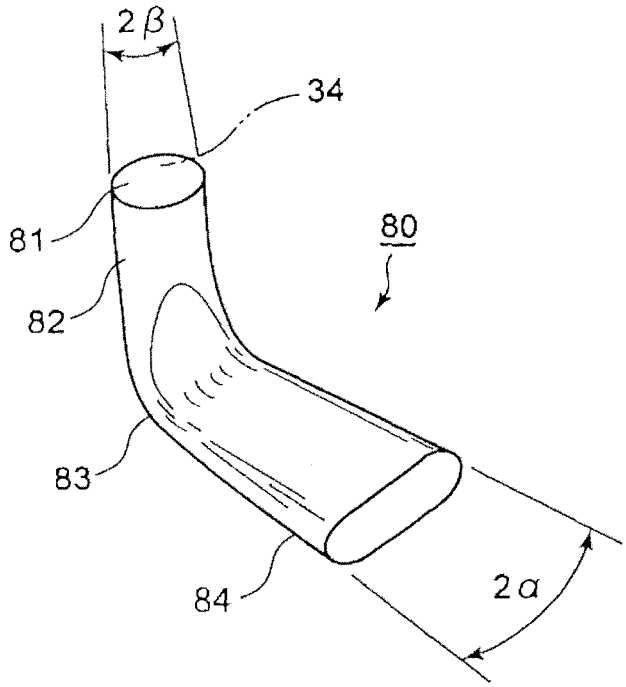
FIG. 7 is a perspective view schematically illustrating an intermediate flow pipe of FIG. 6.

A second embodiment will be described with reference to FIGS. 5 to 7. FIG. 5 is a top view schematically illustrating a steam valve device 90 according to the present embodiment. FIG. 6 is a vertical cross-sectional diagram as viewed along VI-VI line of FIG. 5. FIG. 7 is a perspective view schematically illustrating an intermediate flow pipe 80 of FIG. 6.

The present embodiment is a modification of the first embodiment (FIGS. 1 to 4). The same reference numerals are given to the same or similar parts as those of the first embodiment, and redundant descriptions are omitted. Further, the steam valve device 90 of the present embodiment is used for the steam turbine plant (FIGS. 3 and 4) described in the first embodiment.

A configuration of the intermediate flow pipe 80 of the steam valve device 90 according to the present embodiment will be described. The components other than the intermediate flow pipe 80, i.e., the main steam stop valve 1, the first steam regulating valve 21, and the second steam regulating valve 22 have the same configurations as those of the first embodiment.

As in the first embodiment, the intermediate flow pipe 80 according to the present embodiment has the upper inlet port 81, the vertical flow channel 82, the flow direction changing portion 83, the horizontal flow channel 84, branch portion 85, the first lower outlet port 87, and the second lower outlet port 88.

The vertical flow channel 82 of the present embodiment is formed so as to increase in the width of the cross-section (circular flow path cross-section) from its connection portion with the upper inlet port 81 toward its connection portion with the flow direction changing portion 83, that is, from the upper portion of the vertical flow channel 82 toward the lower portion thereof.

The vertical flow channel 82 of this example has a same shape as the horizontal lower half of a cone, i.e., a partial conical shape. The gradual increase in the width of the flow path enables pressure recovery on the downstream (wake flow) side of the main steam stop valve 1. The degree of the increase in the flow path width at this time, i.e., an angle $\beta$ with respect to a flow path center C is set to about 6 degrees in order to suppress occurrence of the flow separation. In FIG. 7, as the degree of the increase in the flow path width, a state where the flow path expands outward with respect to the flow path center C by the angle of $\beta$ respectively to both sides in the horizontal direction is represented by twice the angle $\beta(2\beta)$.

The flow direction changing portion 83 is connected to the lower portion of the vertical flow channel 82 of a partial conical shape with a predetermined curvature. Hereinafter, connection between the flow direction changing portion 83 and the vertical flow channel 82 will be described.

The flow direction changing portion 83 is, as in the first embodiment, formed into an arc-like pipe (elbow pipe) having an arc angle of about 90 degrees so as to change the flow direction of the main steam from vertical direction to horizontal direction.

As illustrated in FIG. 6, the curvature radius of the flow direction changing portion 83 on the inner circumferential side of the arc is Ri, curvature radius on the outer circumferential side is Ro, and curvature radius of the center of the flow path is Rc. Further, on the outer circumference side, the lower end of the upper flow path and upper end of the curvature radius Ro are connected smoothly with a predetermined curvature radius r. The centers of Ro, Ri, Rc, and r are located at different positions.

As in the case of the first embodiment, it is preferable that the ratio (Rc/Di) between the central radius Re and the entrance inner diameter Di is preferably 1 or more and, more preferably, 2 or more.

Subsequently, a cross-sectional shape of the downstream side from the flow direction changing portion 83 of the intermediate flow pipe 80 will be described.

The circular cross-sectional shape of the flow path at the downstream side is gradually flattened to become a horizontally (depth direction of FIG. 6) long (ellipas or) racetrack share.

The cross-sectional shape of the flow path of the flow direction changing portion 83 at its upper portion, i.e., the cross-sectional shape of the flow path directly below the vertical flow channel 82 is a circular shape. This cross-sectional shape is gradually flattened toward the downstream side, with the result that the cross-sectional shape of the connection portion with the branch portion 85 becomes horizontally long ellipse. The cross-sectional shape of the flow path is deformed with its cross-sectional area kept substantially constant in the process of change in shape from circle to racetrack share along the flow path.

The ellipse-shaped cross-section of the flow path is further flattened from the horizontal flow channel 84 toward the branch portion 85, resulting in a horizontally longer ellipse racetrack share. The cross-section of the flow path is deformed so as to extend in the horizontal direction. That is, the cross-section of the flow path is deformed such that the cross-sectional area of the flow path is smoothly increased. The degree of the increase in the flow path width, i.e., an angle $\alpha$ with respect to a flow path center C is set to about 6 degrees in order to suppress occurrence of the flow separation. In FIG. 7, as the degree of the increase in the flow path width, a state where the flow path expands outward with respect to the flow path center C by the angle of a respectively to both sides in the vertical downward direction is represented by twice the angle $\alpha(2\alpha)$.

The second inlet port 43 of each of the first and the second steam regulating valves 21 and 22 is connected to the vertical direction center portion of the second casing 41. This allows the main steam from the first and the second lower outlet ports 87 and 88 to smoothly flow in the second flow path 71.

The intermediate flow pipe 80 is bent so as to change its extending direction from vertical to horizontal with the circular cross-sectional shape of the flow path in the vicinity of the upper inlet port 81 flattened to become a horizontally-long racetrack share in the vicinity of the branch portion 85. Further, the cross-sectional area of the flow path gradually becomes larger from the portion at which the intermediate flow pipe 80 is not flattened any more.

As described above, according to the present embodiment, deforming the intermediate flow pipe 80 allows occurrence of a secondary flow which is an inner flow peculiar to the elbow pipe (arc-like pipe) described in the first embodiment and fluid separation to be suppressed. As a result, it is possible to avoid an increase in a pressure loss.

Third Embodiment

A third embodiment will be described with reference to FIGS. 8 and 9. FIG. 8 is a top view schematically illustrating a steam valve device 90 according to the present embodiment. FIG. 9 is a vertical cross-sectional diagram as viewed along IX-IX line of FIG. 8.

The present embodiment is a modification of the first embodiment (FIGS. 1 to 4). The same reference numerals are given to the same or similar parts as those of the first embodiment, and redundant descriptions are omitted. Further, the steam valve device 90 of the present embodiment is used for the steam turbine plant (FIGS. 3 and 4) described in the first embodiment.

In the steam valve device 90 of the present embodiment, the first steam regulating valve 21 and the second steam regulating valve 22 are arranged in quasi-series on the downstream side of the intermediate flow pipe 80. Further, the intermediate flow pipe 80 of the steam valve device 90 is configured to allow the main steam discharged from the first outlet port 34 of the main steam stop valve 1 to flow only in the second inlet port 43 of the second steam regulating valve 22. That is, the intermediate flow pipe 80 of the present embodiment does not have the branch portion 85 (FIG. 1) described in the first embodiment.

A horizontally-opened horizontal outlet port 44*a* is formed in the first casing 31 of the first steam regulating valve 21 at a position on the downstream side relative to the second outlet port 44. The horizontal outlet port 44*a* is connected to the second inlet port 43 of the second steam regulating valve 22.

A part of the main steam discharged from the intermediate flow pipe 80 is passed through the inside of the second casing 41 of the first steam regulating valve 21 and flows in the second steam regulating valve 22. That is, when the second valve element 42 of the upstream side first steam regulating valve 21 is closed, all the main steam flowing in the first steam regulating valve 21 is discharged from the horizontal outlet port 44*a* of the first steam regulating valve 21 and then flows in the second steam regulating valve 22. In this case, the main steam flows serially through the first and second steam regulating valves 21 and 22.

On the other hand, when the second valve element 42 of the upstream side first steam regulating valve 21 is opened, the main steam flowing in the first steam regulating valve 21 is branched into two flows. One is discharged from the second outlet port 44 of the first steam regulating valve 21 and flows in the first section 15 (FIG. 4) of the nozzle box, and the other is discharged from the horizontal outlet port 44*a* and flows in the second steam regulating valve 22.

When the second valve element 42 of the second steam regulating valve 42 is opened, the main steam flowing in the second steam regulating valve 22 is discharged from the second outlet port 44 of the second steam regulating valve 22 and flows in the second section 16 (FIG. 4) of the nozzle box.

As a result, the same effects as those of the first embodiment can be obtained. Further, the shape of the intermediate flow pipe 80 can be simplified, which contributes to a reduction in the manufacturing cost.

Other Embodiments

The embodiments described above are merely given as examples, and it should be understood that the present invention cited in claims is not limited thereto. Further, the configurations of respective components of the present invention are not limited to the above embodiments but may be variously changed within the technical scope of the claims.

For example, in the first embodiment, the vertical flow channel 82 and the horizontal flow channel 84 may be omitted. In this case, the upper portion of the flow direction changing portion 83 is connected to the upper inlet port 81, and the branch portion 85 is connected to the lower part of the flow direction changing portion 83.

Further, in the second embodiment, the cross-sectional shape of the horizontal flow channel 84 may be an ellipse with a horizontal major axis and a minor axis along the axial direction (vertical direction) of the steam regulating valve.

Further, the flow direction changing portion 83 described in the second embodiment may be provided in the intermediate flow pipe 80 of the steam valve device 90 of the third embodiment.

For a steam turbine having a nozzle box partitioned into four sections, two steam valve devices 90 of the first embodiment, the second embodiment, or the third embodiment can be used.

Although the two steam regulating valves 21 and 22 are connected to one main steam stop valve 1 in the first to third embodiments, three or more steam regulating valves may be connected to one main steam stop valve 1.

Further, the steam regulating valve as described in the third embodiment may be provided in each of the parallel-arranged first and second steam regulating valves 21 and 22.

What is claimed is:

1. A steam valve device configured to be attached to a steam turbine via a nozzle box, the steam valve device comprising:

a single main steam stop valve;

a plurality of steam regulating valves disposed on a downstream side of the main steam stop valve, each of the plurality of steam regulating valves configured to be connected to a respective one of a plurality of circumferentially arranged and partitioned sections of the nozzle box, the plurality of steam regulating valves comprising at least a first steam regulating valve adjacent to the main steam stop valve, and a second steam regulating valve adjacent to the first steam regulating valve; and an intermediate flow pipe connecting the main steam stop valve to the plurality of steam regulating valves, wherein the steam valve device is configured to control flow of main steam generated by a boiler to the plurality of sections of the nozzle box, wherein the main steam stop valve includes:

a first casing having a first inlet portion extending in a first direction, a first outlet portion extending in a second direction perpendicular to the first direction and is connected to the intermediate flow pipe, a first flow path formed between the first inlet portion and the first outlet portion, and a first valve seat arranged in the first flow path;

a first valve element configured to move along the second direction in the first casing and to leave and contact the first valve seat to open and close the first flow path; and a first valve rod connected to the first valve element, configured to slide along the second direction, penetrating the first casing, the first valve rod being configured to move the first valve element away from the first outlet portion to open the first flow path and to move the first valve element to the first outlet portion to close the first flow path, wherein each of the steam regulating valves includes:

a second casing having a second inlet portion extending in the first direction so as to be connected to the intermediate flow pipe, a second outlet portion extending in the second direction, a second flow path formed between the second inlet portion and the second outlet portion, and a second valve seat arranged in the second flow path;

a second valve element configured to move along the second direction in the second casing and to leave and contact the second valve seat to open and close the second flow path; and a second valve rod connected to the second valve element, configured to slide along the second direction, penetrating the second casing, the second valve rod being configured to move the second valve element away from the second outlet portion to open the second flow path and to move the second valve element to the second outlet portion to close the second flow path, wherein the intermediate flow pipe is configured to change a flow direction of the main steam flowing out from the first outlet portion from the second direction to the first direction to allow the main steam to flow into the second inlet portions, wherein the intermediate flow pipe includes:

an intermediate flow pipe inlet portion extending in the second direction so as to communicate with the first outlet portion;

a plurality of intermediate flow pipe outlet portions extending in the first direction at a position lower than the intermediate flow pipe inlet portion so as to communicate with the second inlet portions; and a branch portion formed between the intermediate flow pipe inlet portion and the intermediate flow pipe outlet portions so as to allow the main steam flowing through the intermediate flow pipe inlet portion to flow into the intermediate flow pipe outlet portions, the branch portion being directly connected to each of the steam regulating valves, wherein the main steam stop valve, the steam regulating valves, and the intermediate flow pipe are integrally formed, wherein in the intermediate flow pipe there are formed:

a first flow portion defining a first flow channel and extending in the second direction to allow the main steam to flow from the intermediate flow pipe inlet portion;

a direction changing flow portion defining a direction changing flow channel and being connected to the first flow portion so as to change the flow direction of the main steam from the second direction to the first direction;

a second flow portion defining a second flow channel and being connected to the direction changing flow portion so as to allow the main steam flowing out from the direction changing flow portion to flow in the first direction into the branch portion; and a plurality of outlet flow paths to allow the main steam to flow from the branch portion to the plurality of intermediate flow pipe outlet portions, wherein, in the direction changing flow portion, a curvature radius of a center of a flow path is larger than a curvature radius of an inner circumferential side and smaller than a curvature radius of an outer circumferential side, wherein a center of curvature of the center of the flow path, a center of curvature of the inner circumferential side and a center of curvature of the outer circumferential side are located at different positions, and wherein a curvature of the outer circumferential side is smoothly connected at a predetermined curvature radius with a lower end of the first outlet portion.

2. The steam valve device according to claim 1, wherein the first flow portion is formed such that a flow portion cross-section area thereof is increased from an upstream side to a downstream side, and the second flow portion is formed such that a flow portion cross-section area thereof is increased, toward the branch portion, in a direction perpendicular to the flow direction and the second direction.

3. The steam valve device according to claim 1, wherein the direction changing flow portion is formed such that a flow portion cross-section area thereof is not reduced from a connection portion that is connected with the first flow portion toward another connection portion that is connected with the second flow portion.

4. A steam turbine plant comprising:

the steam valve device according to claim 1, the boiler configured to generate the main steam;

the steam turbine configured to receive the main steam generated in the boiler and to be driven by energy of the main steam; and the nozzle box configured to receive the main steam generated in the boiler and supply the main steam to the steam turbine so as to control flow of the main steam.

5. The steam turbine plant according to claim 4, wherein the first direction is a horizontal direction and the second direction is a vertical direction.

6. The steam turbine plant according to claim 4, wherein the intermediate flow pipe is disposed at a height lower than a height of the first outlet portion of the main steam stop valve.

7. The steam valve device according to claim 1, wherein the first direction is a horizontal direction and the second direction is a vertical direction.

8. The steam valve device according to claim 1, wherein the first outlet portion and the second outlet portion are opened downward.

9. The steam valve device according to claim 1, wherein the steam regulating valves are connected to the intermediate flow pipe in parallel.

10. The steam valve device according to claim 1, wherein the intermediate flow pipe is disposed at a height lower than a height of the first outlet portion of the main steam stop valve.

11. The steam valve device according to claim 1, wherein each of the plurality of steam regulating valves is configured to be opened one by one in sequence to allow the main steam generated by the boiler to flow into the nozzle box.

12. The steam valve device according to claim 11, wherein during a partial load condition of the steam turbine, at least one of the plurality of steam regulating valves is fully opened, thereby suppressing a throttle loss.

13. A steam valve device configured to be attached to a steam turbine via a nozzle box, the steam valve device comprising:

a main steam stop valve;

an upstream side steam regulating valve disposed on a downstream side of the main steam stop valve and adjacent to the main steam stop valve;

a downstream side steam regulating valve disposed on a downstream side of the upstream side steam regulating valve and adjacent to the upstream side steam regulating valve; and an intermediate flow pipe connecting the main steam stop valve to the upstream side steam regulating valve, wherein the upstream side steam regulating valve and the downstream side steam regulating valve are respectively configured to be connected to a first section and a second section of a plurality of circumferentially arranged and partitioned sections of the nozzle box, wherein the steam valve device is configured to control flow of main steam generated by a boiler to the plurality of sections of the nozzle box, wherein the main steam stop valve includes:

a first casing having a first inlet portion extending in a first direction, a first outlet portion extending in a second direction perpendicular to the first direction and is connected to the intermediate flow pipe, a first flow path formed between the first inlet portion and the first outlet portion, and a first valve seat arranged in the first flow path;

a first valve element configured to move along the second direction in the first casing and to leave and contact the first valve seat to open and close the first flow path; and a first valve rod connected to the first valve element, configured to slide along the second direction, penetrating the first casing, the first valve rod being configured to move the first valve element away from the first outlet portion to open the first flow path and to move the first valve element to the first outlet portion to close the first flow path, wherein the upstream side steam regulating valve includes:

a second casing having a second inlet portion extending in the first direction so as to be connected to the intermediate flow pipe, a second outlet portion extending in the second direction, another second outlet portion extending in the first direction on a downstream side relative to the second outlet portion, a second flow path communicating with the second inlet portion, the second outlet portion, and the another second outlet portion, and a second valve seat arranged in the second flow path;

a second valve element configured to move along the second direction in the second casing and to leave and contact the second valve seat to open and close the second flow path; and a second valve rod connected to the second valve element, configured to slide along the second direction, penetrating the second casing, the second valve rod being configured to move the second valve element away from the second outlet portion to open the second flow path and to move the second valve element to the second outlet portion to close the second flow path, wherein the downstream side steam regulating valve includes:

a third casing having a third inlet portion extending in the first direction so as to be connected to and disposed adjacent to the another second outlet portion, a third outlet portion extending in the second direction, a third flow path formed between the third inlet portion and the third outlet portion and a third valve seat arranged in the third flow path;

a third valve element configured to move along the second direction in the third casing and to leave and contact the third valve seat to open and close the third flow path; and a third valve rod connected to the third valve element, configured to slide along the second direction, penetrating the third casing, and configured to move away from the third outlet portion when the third flow path is opened, wherein the intermediate flow pipe is configured to change a flow direction of the main steam flowing out from the first outlet portion from the second direction to the first direction to allow the main steam to flow in the second inlet portion, wherein the main steam stop valve, the steam regulating valves, and the intermediate flow pipe are integrally formed, wherein, in a direction changing flow portion of the intermediate flow pipe, a curvature radius of a center of a flow path is larger than a curvature radius of an inner circumferential side and smaller than a curvature radius of an outer circumferential side, wherein a center of curvature of the center of the flow path, a center of curvature of the inner circumferential side and a center of curvature of the outer circumferential side are located at different positions, and wherein a curvature of the outer circumferential side is smoothly connected at a predetermined curvature radius with a lower end of the first outlet portion.

14. The steam valve device according to claim 13, wherein the first direction is a horizontal direction and the second direction is a vertical direction.

15. The steam valve device according to claim 13, wherein the intermediate flow pipe is disposed at a height lower than a height of the first outlet portion of the main steam stop valve.

16. A steam turbine plant comprising:

the steam valve device according to claim 13;

the boiler configured to generate the main steam;

the steam turbine configured to receive the main steam generated in the boiler and to be driven by energy of the main steam; and the nozzle box configured to receive the main steam generated in the boiler and supply the main steam to the steam turbine so as to control flow of the main steam.

17. The steam valve device according to claim 13, wherein the upstream side steam regulating valve and the downstream side steam regulating valve are configured to be opened one by one in sequence to allow the main steam generated by the boiler to flow into a respective one of the first section and the second section of the nozzle box.

18. The steam valve device according to claim 17, wherein during a partial load condition of the steam turbine, at least one of the upstream side steam regulating valve and the downstream side steam regulating valve is fully opened, thereby suppressing a throttle loss.

* * * * *